United States Patent [19]

Rice

[11] 4,059,493

[45] Nov. 22, 1977

[54] ANODE, ANODE BASKET AND METHOD OF PACKAGING ANODES

[75] Inventor: Seymour S. Rice, Southbury, Conn.

[73] Assignee: Cities Service Company, Tulsa, Okla.

[21] Appl. No.: 681,622

[22] Filed: Apr. 29, 1976

[51] Int. Cl.[2] ..... C25D 17/10

[52] U.S. Cl. ..... 204/3; 204/14 R; 204/280; 204/287; 204/1 R

[58] Field of Search ..... 204/3, 14 R, 213, 280, 204/287; 336/232; 267/156

[56] References Cited

U.S. PATENT DOCUMENTS

| | | | |
|---|---|---|---|
| 2,198,073 | 4/1940 | Bayless et al. | 336/232 |
| 2,559,926 | 7/1951 | Beebe | 204/297 |
| 2,600,107 | 6/1952 | Gelfand et al. | 204/287 |
| 2,934,785 | 5/1960 | Heuer | 267/156 |
| 3,058,078 | 10/1962 | Hoh | 336/232 |
| 3,334,039 | 8/1967 | Vlasak | 204/280 |
| 3,409,530 | 11/1968 | Locke et al. | 204/147 |
| 3,518,394 | 6/1970 | Dawson | 336/232 |
| 3,827,017 | 7/1974 | Keller | 336/232 |
| 3,862,745 | 1/1975 | Chiz | 204/287 |

*Primary Examiner*—T. Tung

*Attorney, Agent, or Firm*—Richard S. Strickler; Donald L. Traut

[57] ABSTRACT

An anode configuration, anode basket and method of packaging anodes within the basket.

11 Claims, 10 Drawing Figures

FIG. 6
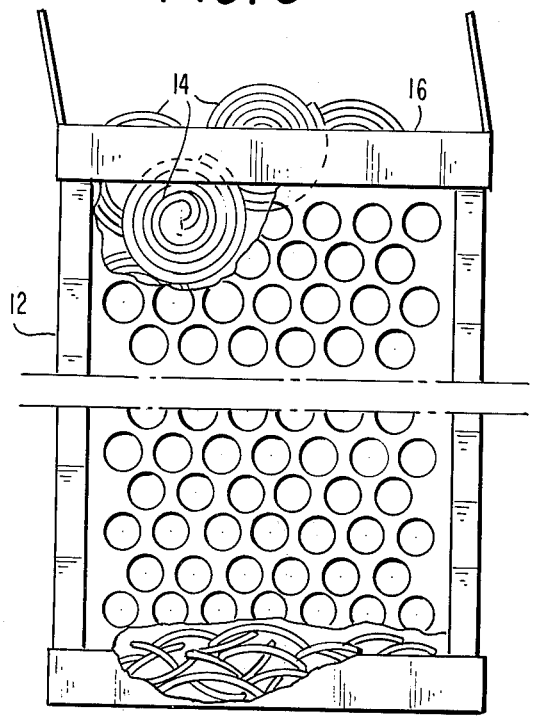
FIG. 10
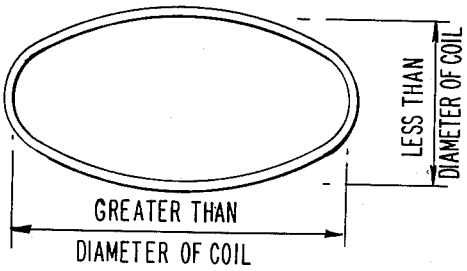
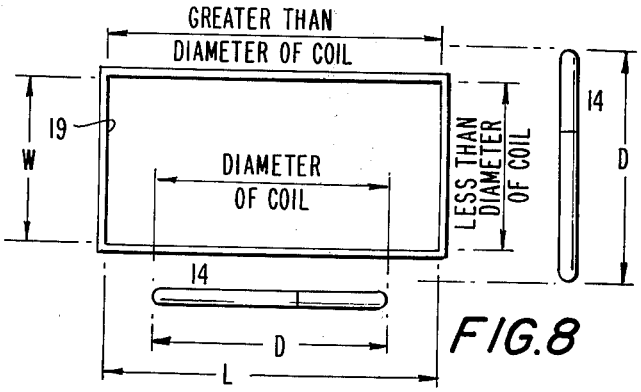
FIG. 8
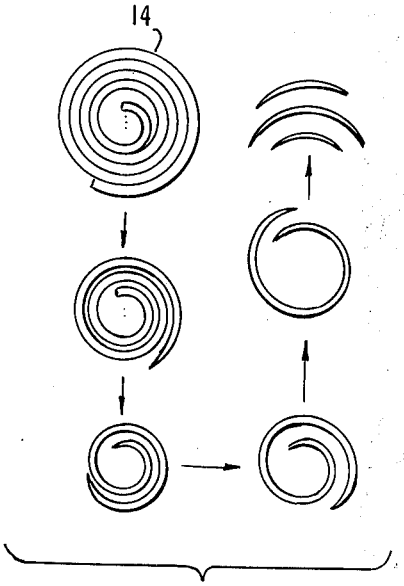
FIG. 7
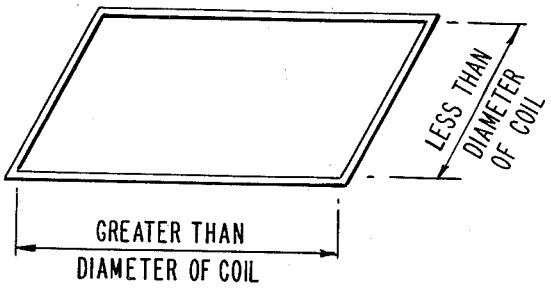
FIG. 9

ANODE, ANODE BASKET AND METHOD OF PACKAGING ANODES

BACKGROUND OF THE INVENTION

The present invention relates to electroplating or electroforming and relates in particular to anode configuration, anode basket structure and cooperation between anodes and anode baskets to achieve (1) continuous maximum exposure of anode surface to electrolyte, (2) improved circulation of electrolyte throughout the basket during the course of anode corrosion, (3) minimum generation of sludge, (4) good balance among exposed anode surface area, unit weight of anode and space occupied by anodes.

Prior art anode configurations frequently take the form of chips, spheres, cubes, short rods and the like, which tend to nest, compact or consolidate during the course of a plating operation so as to cause inefficient corrosion and slow plating speeds.

It has been found that the above anode forms are undesirable because they suffer, in one manner or another, from defects such as inadequate surface area exposed to electrolyte, excessive sludge or sediment formation, reduced electrical conductivity from anode to anode and between anodes and the anode basket.

Typical prior art anodes over which the present invention is an improvement are shown and described in U.S. Pat. Nos. 1,868,052, 1,478,853 and 1,373,693.

A particular feature of the present invention is the provision of a novel anode structure which is susceptible of manufacture in large quantities at low cost using modern mass production techniques.

Another feature of the invention is the provision of an anode-anode basket combination which insures vertical side-by-side stacking of anodes within the anode baskets when dropped or fed manually or automatically through an anode basket loading opening.

A further feature of the invention is the provision of a combined anode-anode basket arrangement in which the anodes migrate to the bottom of the basket as corrosion occurs while continually maintaining the vertical position of each anode and good anode to anode and anode to basket contact with free circulation of the electrolyte throughout the anode life cycle and until the anode is completely ionized.

A still further feature of the invention is the provision of a novel method of packaging anodes within an anode basket suitable for immersion into an electrolytic bath.

A further feature of the invention is the provision of a novel electrolytic process.

SUMMARY OF THE INVENTION

An anode structure embracing certain features of the present invention may comprise: a coil of anode material generally defining a plurality of convolutions or turns, said convolutions being formed from a continuous rod, said anode further defining a flat, generally planar surface, said rod having a cross-section whose periphery defines a predetermined configuration along a portion of said periphery, the convolutions of said coil being so formed that said predetermined configuration of said cross-section faces radially outwardly in at least the outermost of said convolutions.

A combined anode and anode basket embracing certain other features of the invention may comprise a convolutely wound coil of anode material formed of rod or wire, said rod having a cross-section defining an arcuate configuration in at least a portion of the periphery of the cross-section, said rod being wound so that said arcuate configuration of said cross-section of each convolution of said coil faces outwardly, and a perforate anode basket having a loading opening generally defining a parallelogram, the outer diameter of said coil being dimensioned so that it is greater than the width of the parallelogram but less than the length thereof, whereby said coils stack in a predetermined pattern within the basket when the coils are fed through the loading opening.

An electrolytic process for transferring corrosive anodic material from an anode to a work piece defining a cathode and embracing certain other features of the invention may comprise the steps of: winding anodic rod material having a predetermined configuration in cross-section into convolute coils of predetermined size, said coils having planar or flat surfaces, packaging the coils within a perforate basket so that the planar surfaces of one coil are generally vertical and generally parallel to the planar surfaces of another coil, and circulating electrolyte through said basket into contact with said coils whereby the corrosive action occurs uniformly throughout the basket by virtue of the configuration of coils and the disposition of the coils within the basket.

BRIEF DESCRIPTION OF THE DRAWINGS

Other features and advantages of the invention will become more apparent from an examination of the suceeding specification when read in conjunction with the appended drawings, in which;

FIG. 6 is a loaded anode basket, somewhat enlarged, with parts broken away to show progressive corrosion of anodes as they migrate automatically from the top to the bottom of an anode basket.

FIG. 7 shows a typical "life" cycle of an anode as it corrodes; the cycle progresses as shown by the arrows in this figure.

FIG. 8 shows the dimensional relationship of the outer diameter of the anode coil and a rectangular loading opening of an anode basket.

FIGS. 9 and 10 show alternative embodiments of a loading opening, namely a parallelogram and an elliptic opening.

DETAILED DESCRIPTION OF THE INVENTION

Figure 1:
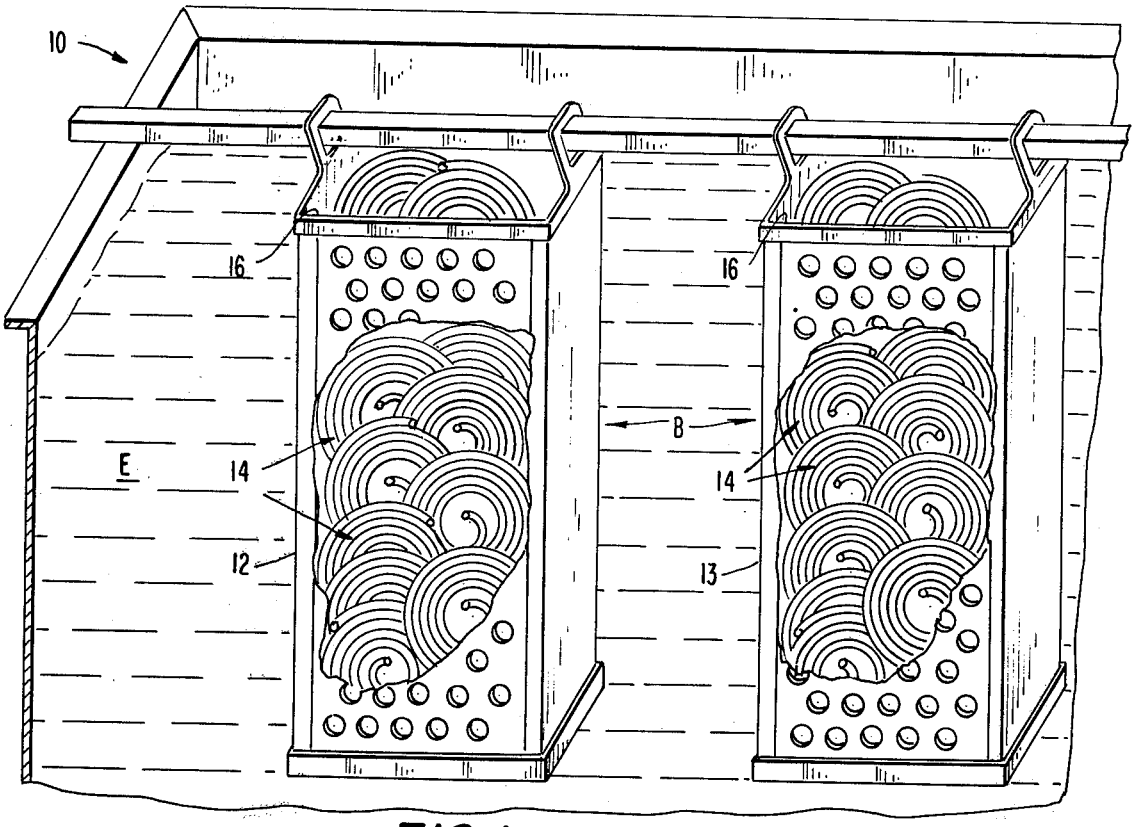
FIG. 1 shows a portion of an electrolytic bath with loaded anode baskets in operating position and supported within the bath.

Referring now to the drawings, and in particular to FIG. 1, the reference numeral 10 designates a typical electrolytic bath containing electrolyte E and anode baskets shown generally at B.

Bar 11 supports perforate anode baskets 12 and 13 suspended within the electrolyte. The baskets are shown partially broken away to disclose a plurality of fresh anodes 14—14 neatly stacked in a generally vertical position within the baskets.

The anodes 14—14, generally defining a coil, are disposed vertically and nest automatically with a slight wedging action in the manner shown when dropped or fed manually or automatically through loading opening 16 in a manner and for reasons that will become more apparent as the specifications proceeds.

The anodes 14—14 feed or migrate downwardly automatically as corrosion occurs, maintaining their generally vertical disposition throughout the anode life cycle. The anode life cycle is shown with particularity in FIG. 7.

Figure 2:
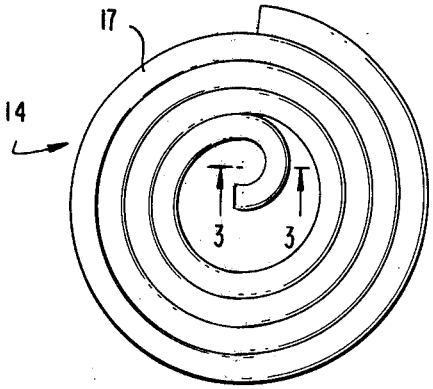
FIG. 2 is a plan view of one embodiment of an anode of the present invention.

The anodes 14—14 are fabricated from anode material (in rod form) such as, but not limited to, copper, zinc, cadmium or nickel and are wound convolutely as shown in FIG. 2 to define a coil having a number of convolutions or turns and having a flat, generally planar surface in the wound or finished condition.

Figure 3:
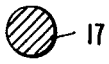
FIG. 3 is a partial section of the anode of FIG. 2 as viewed in the plane of the line 3—3.
Figure 5:
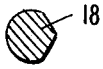
FIG. 5 is a partial section of FIG. 4 as viewed in the plane of line 5—5 illustrating a nose or share which is angular rather than arcuate.
Figure 4:
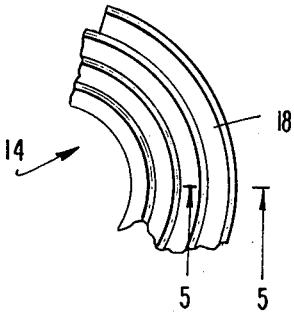
FIG. 4 is an alternative anode embodiment.

The starting rod material may vary in cross-sectional configuration as evidenced by the rod sectional views of FIGS. 3 and 5.

The only limitation of each coil is that the rod cross-sectional configuration be so shaped and the rod so wound that an arcuate, angular nose or share (as indicated at 17 in FIG. 3 and at 18 in FIG. 5, respectively,) is presented outwardly in at least the outermost convolution or turn of each coil 14.

The significance of the nose or share 17—17 and 18—18 is that this configuration (rod cross-sectional configuration) encourages each anode 14 to "nose" its way downwardly as it migrates to the bottom of the anode basket. This downward motion occurs automatically as corrosion progresses and is aided greatly by the anode share and the vertical and generally parallel disposition of anodes.

The anode basket, fabricated of material which is not soluble in electrolyte, has critical dimensions relative to the outer diameter of the anode coils 14—14.

As illustrated in FIG. 8 the rectangular opening 19 has a width W which is less than the coil diameter D and a length L which is greater than D.

The significance of this dimensional relationship resides in the fact that a basket opening and coil so dimensioned insures that coils will stack generally vertically and generally parallel to one another when dropped or fed manually or automatically through the loading opening 19.

Note that the gradual migration of the anode 14 occurs without disturbing the generally vertical, generally parallel position of the anodes 14—14 (while maintaining good anode to anode and anode to basket contact) and facilitates free access of electrolyte to the surface of the anodes or coils as they corrode from the configuration shown in the upper left of FIG. 7 to the ultimate configuration shown in the upper right of FIG. 7.

In summary, the salient features and advantages of the present invention are as follows:

1. Continuous exposure of maximum surface area of anodes to electrolyte during the full life cycle of the anode as it migrates from the top of the basket to the bottom.

2. Minimum generation of sludge or sediment.

3. Maximum flow of electrolyte passed anode material throughout the full depth of the anode basket.

4. Maintenance of good electrical contact among anodes and between anodes and the anode basket throughout the anode life cycle.

All of the above features and advantages result in improved electroplating efficiency and faster plating speeds.

It is anticipated that various modifications and design changes may be made in the present invention without departing from the spirit and scope thereof.

What is claimed is:

1. In combination, a plurality of convolutely wound lengths of anode material formed of rod or wire, defining a plurality of coils, said rod having a cross-section defining a predetermined configuration in at least a portion of the periphery of the cross-section, said rod being wound so that said predetermined configuration of said cross-section of each convolution of each said coil faces radially outwardly, each said coil being generally planar or flat, and a perforate anode basket having an elongate loading opening, said opening having a width and a length, the outer diameter of each said coil being dimensioned so that it is greater than the width of the opening but less than the length thereof, whereby said coils stack freely in a predetermined pattern within the basket when the coils are fed through the opening.

2. The combination of claim 1 where the rod is fabricated of anode material such as copper, zinc, cadmium or nickel and the basket is fabricated of material which is not soluble in the electrolyte.

3. The combination of claim 1 where the loading opening of said basket generally defines an elliptic figure having a major and a minor axis, the outer diameter of each said coil being greater than said minor axis but less than said major axis.

4. The combination of claim 1 in which said predetermined configuration of that portion of the periphery of the cross-section of the rod which faces radially outwardly subtends an angle of less than 180°.

5. The combination of claim 1 in which the loading opening defines a rectangle.

6. The combination of claim 1 where the loading opening of said basket generally defines a parallelogram, the outer diameter of each said coil being greater than the width of said parallelogram but less than the length thereof.

7. The combination of claim 1 in which said predetermined configuration of the portion of the periphery of the cross-section of the rod which faces radially outwardly is arcuate.

8. The basket of claim 1 wherein the horizontal cross-section of said basket is a parallelogram having a length and a width, said outer diameter of each said coil being greater than the width of said parallelogram and said length of said parallelogram is greater than said diameter.

9. The combination of claim 1 wherein said predetermined configuration of said cross-section of each convolution is a semicircle.

10. A method of packaging a plurality of anodic units within an anode basket comprising the steps of: providing an anode basket having a loading opening, said opening having a width and a length, providing a rod of anodic material, said rod having a cross-section defining a nose or share portion, winding said rod convolutely into a coil so that said nose portion faces radially outwardly in each convolution, and so that said coil is generally planar or flat, dimensioning the outer diameter of said convolutely wound rod so that it is greater than the width of said basket opening but less than the length thereof and feeding said anodic units into the basket through said opening whereby said units, by virtue of the method of manufacture, stack within the basket in accordance with a predetermined pattern or array automatically.

11. An electrolytic process for transferring corrosive anodic material from an anode to a work piece defining a cathode within a conventionally energized electrolytic bath comprising the steps of: winding anodic rod material into convolute coils of predetermined size, said rod material having a predetermined configuration in a portion of the periphery of the cross-section thereof, each said coil being planar or flat, packaging the coils within a perforate basket so that each planar coil is disposed generally vertical and generally parallel to other coils, and circulating electrolyte through said basket into contact with said coils whereby the corrosive action occurs uniformly throughout the basket by virtue of the configuration of coils and the disposition of the coils within the basket.

* * * * *